US009504882B2

(12) United States Patent
Adamczak

(10) Patent No.: US 9,504,882 B2
(45) Date of Patent: Nov. 29, 2016

(54) INTERACTIVE TENNIS RACKET WITH SPLIT HEAD, FLEXIBLE SPHERICAL JOINTS AND STRINGS TENSION MECHANISM

(71) Applicant: Gregory Mark Adamczak, Stamford, CT (US)

(72) Inventor: Gregory Mark Adamczak, Stamford, CT (US)

( * ) Notice: Subject to any disclaimer, the term of this patent is extended or adjusted under 35 U.S.C. 154(b) by 0 days.

(21) Appl. No.: 14/696,666

(22) Filed: Apr. 27, 2015

(65) Prior Publication Data

US 2016/0310804 A1 Oct. 27, 2016

(51) Int. Cl.
*A63B 49/02* (2015.01)
*A63B 51/00* (2015.01)
*A63B 51/12* (2006.01)

(52) U.S. Cl.
CPC ..... *A63B 49/02* (2013.01)

(58) Field of Classification Search
CPC .... A63B 49/00; A63B 49/02; A63B 49/022; A63B 49/028; A63B 49/03; A63B 49/08; A63B 51/00; A63B 51/12
USPC ..... 473/524, 34
See application file for complete search history.

(56) References Cited

U.S. PATENT DOCUMENTS 1,808,035 A * 6/1931 Guenard ..... A63B 49/038 473/532
1,832,298 A * 11/1931 Greenspan ..... A63B 49/035 473/531
2,165,701 A * 7/1939 Goerke ..... A63B 51/12 473/534
2,206,548 A * 7/1940 Goerke ..... A63B 51/12 473/534
4,052,060 A * 10/1977 Balkcom ..... A63B 49/035 473/531
4,057,249 A * 11/1977 Reedhead ..... A63B 51/12 473/534
4,203,597 A * 5/1980 Reedhead ..... A63B 51/12 473/534
4,595,201 A * 6/1986 Fischer ..... A63B 51/00 473/534
4,754,968 A * 7/1988 Fischer ..... A63B 51/00 473/534
5,029,857 A * 7/1991 von Hackewitz ..... A63B 51/12 473/534
5,108,114 A * 4/1992 Marx ..... A63B 49/035 16/422
5,919,104 A * 7/1999 Mortvedt ..... A63B 51/00 473/538
6,027,420 A * 2/2000 Soong ..... A63B 49/03 473/540
6,432,005 B1 * 8/2002 Lin ..... A63B 51/00 473/540
6,935,975 B2 * 8/2005 Chang ..... A63B 49/08 473/523
6,955,618 B1 * 10/2005 Mitchell ..... A63B 51/12 473/534
2009/0163306 A1 * 6/2009 Rosenkranz ..... A63B 49/03 473/546
2011/0003654 A1 * 1/2011 Rosenkranz ..... A63B 49/02 473/546

* cited by examiner

*Primary Examiner* — Raleigh W Chiu
(74) *Attorney, Agent, or Firm* — Hess Patent Law Firm LLC; Robert J. Hess

(57) ABSTRACT

The tennis racket for interacting with the tennis ball has the flexible head, the flexible handle, and the string tension mechanism. The tennis racket head form with the handle the flexible spherical joint, with the inner adjustment of the tension, and the angle of the head. The tennis racket handle has flexible gripping to absorb the impact from the incoming tennis ball. The string tension mechanism is operated manually for the adjustment the tension. The structure flexibility of the tennis racket minimizes the injury, and offers more enjoyment of the play.

22 Claims, 10 Drawing Sheets

INTERACTIVE TENNIS RACKET WITH SPLIT HEAD, FLEXIBLE SPHERICAL JOINTS AND STRINGS TENSION MECHANISM

FIELD OF THE INVENTION

The present invention relates to an interactive tennis racket. Specifically, the present invention relates to the tennis racket with flexible joints and the strings tension mechanism.

The tennis racket of the present invention allows one to select the direction of the head angle and the strings tension for users preferences.

The tennis racket head is split and assembled with flexible spherical joints, pulleys and flexible balls. Such flexible assembly controls and minimizes the oscillation, shock impact, decreases the muscles stress, and improves the comfort for the player by a dampening effect during the period of such control and minimization.

The strings tension in the flexible head assembly results in less vibration and more sufficient impact of the tennis ball.

The frame of the head racket is assembled in the nest of the handle and creates the flexible joint that reduces the impact from the striking tennis ball.

The flexible handle assembly provides the gripping to control the oscillation, twisting torque from racket frame, and as a result minimizes wrist injures.

The strings tension mechanism allows the user to adjust the desired level of the string tension during tennis play.

The flexibility of the tennis racket facilitates less muscle stress and offers more enjoyment, and enables a technically oriented pattern of the tennis play.

BACKGROUND OF THE INVENTION

The optional criteria for the tennis racket is to maximize the performance while minimizing the risk of injury.

In general, tennis rackets employ a frame with strings, or a frame, a head, a handle, and strings. Such construction of the tennis racket affects the load to the hand, the arm, and the shoulder of the tennis player. The loads by the incoming tennis ball on the tennis racket results—vibration, shock, and twisting These loads are determinates of the risk for injury.

The vibrations result from the strings and from the oscillation of the racket frame. These types of oscillations create an adequate level of resulting energy and require the muscle activation to withhold such reaction. The frame structure has influence on the amplitude of the vibration. Therefore, gripping the handle tighter decreases the oscillation of the energy, but transforms the energy to the forearm muscles and results in lessening the risk of injury.

When the tennis ball strikes the tennis racket, a shock develops that causes a reaction in the hand and the arm to the shock. To withstand and remove shock energy, the muscles have to be activated and act as the shock absorber. This reaction results in lessening of the risk of injury.

Another reaction is when the tennis ball strikes the center of the tennis racket, and this results in a twisting torque. The muscles react to control this condition and therefore result in lessening the risk of the wrist to injury.

SUMMARY OF THE INVENTION

It an object of the present invention to provide an interactive tennis racket, with personalized parameters; the head angle, the hardness of flexible balls, and the strings tension.

It is an object of the present invention to provide the tennis racket, with the selection of the angle of the head in respect to the handle, and can be selected by the user, as desired.

It is an object of the present invention to provide the tennis racket, in which the head is split, and assembled by spherical joints and flexible balls.

It is an object of the present invention to provide the spherical nest, to assemble the head and the handle.

It is an object of the present invention to provide the tennis racket with a flexible head assembly.

It is an object of the present invention to provide the tennis racket with a flexible handle assembly.

It is an object of the present invention to provide the tennis racket with the strings tension mechanism, where the strings are in the contact with a pulley, and in such, a pattern to allow better sliding of the strings in the tension process.

It is an object of the present invention to provide the tennis racket with the retractable handle to apply the torque during the strings tension process.

It is an object of the present invention to provide the means to apply the dial torque wrench to monitor the level of strings tension.

DETAILED DESCRIPTION OF THE INVENTION

Exemplary embodiments of the present invention may be further understood with reference to the following description and related appended drawings.

Figure 1:
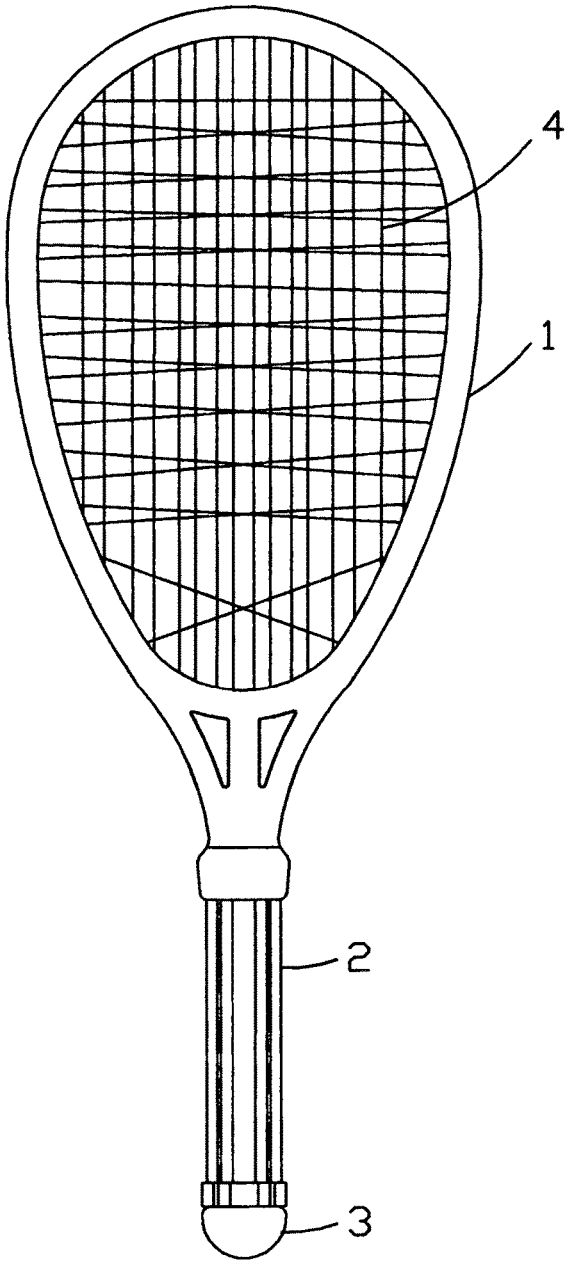
FIG. 1 is a front view of the tennis racket of the present invention.

Referring to the FIG. 1, the tennis racket is provided. The tennis racket includes the head 1, the handle 2, the strings tension mechanism 3, and the strings 4.

The tennis racket in FIGS. 1-5 is split centrally. On one side is the bottom segment 6 and the other side is the top segment 7.

Figure 4:
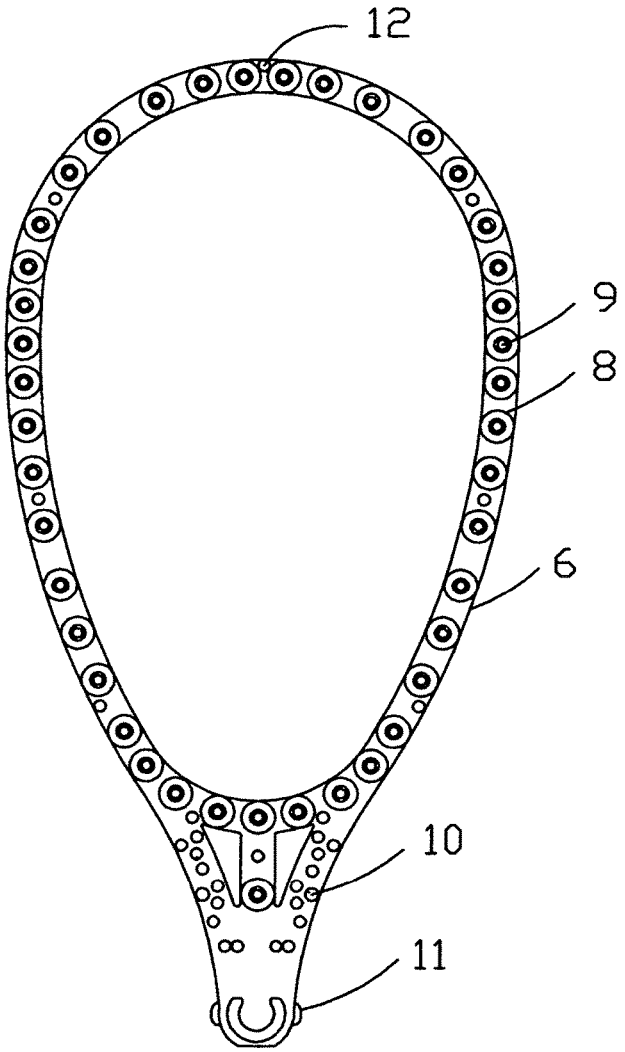
FIG. 4 is a front view of the tennis racket FIG. 1, showing the bottom segment of the tennis racket head.

As shown in FIG. 4, the bottom segment 6 assembly has an extruded frame shape with inside opening 16, 17 and 18, the pulley 8, the flexible balls 12, the string guides, the strings 4.

Figure 5:
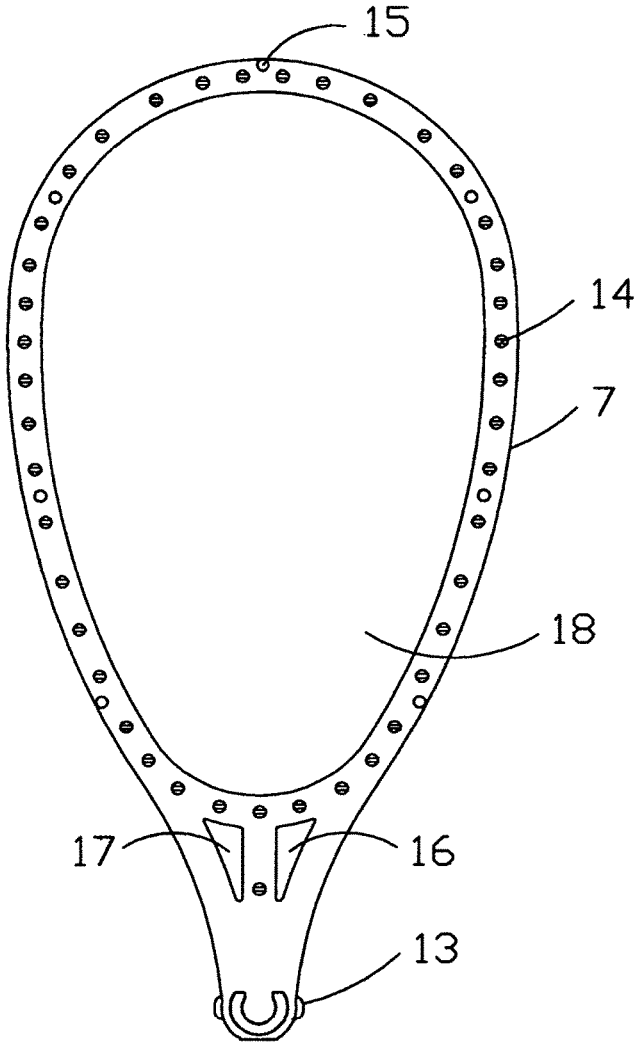
FIG. 5 is a front view of the tennis racket FIG. 1, showing the top segment of the tennis racket head.

As shown in FIG. 5, the top segment 7 has an extruded frame shape mirroring the bottom segment 6. There is some elimination of friction, by free rotation of the pulley in the grove and the pattern of strings.

Figure 2:
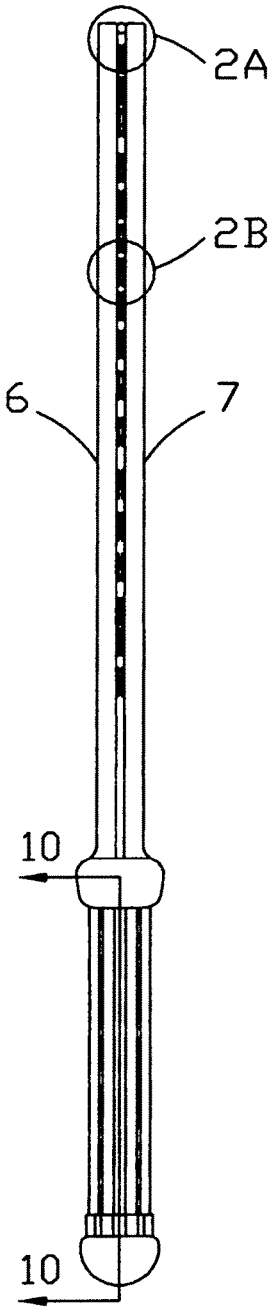
FIG. 2 is a side view of the tennis racket of FIG. 1.
Figure 2A:
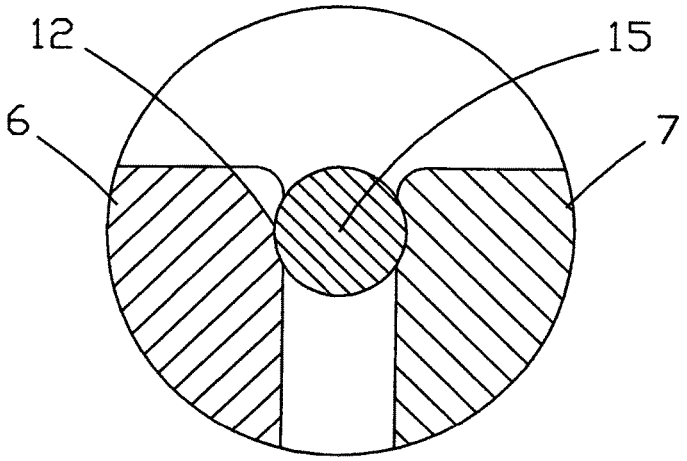
FIG. 2A is an enlarged, sectional view of the tennis racket of FIG. 2 at 2A, showing the flexible ball assembly of the present invention.
Figure 2B:
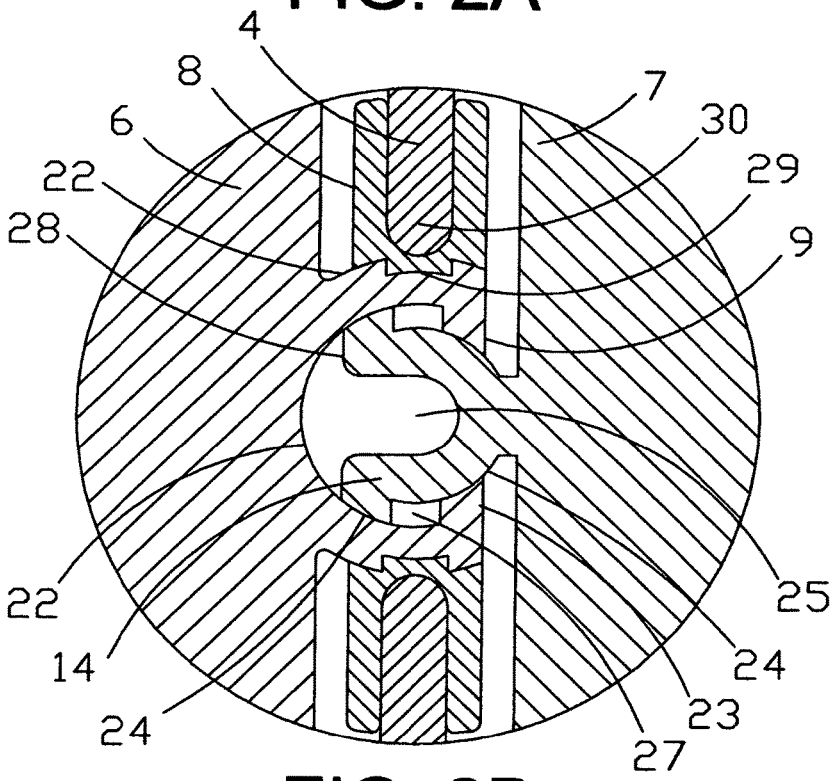
FIG. 2B is an enlarged, sectional view of the tennis racket of FIG. 2 at 2B, showing the spherical joint assembly.
Figure 3:
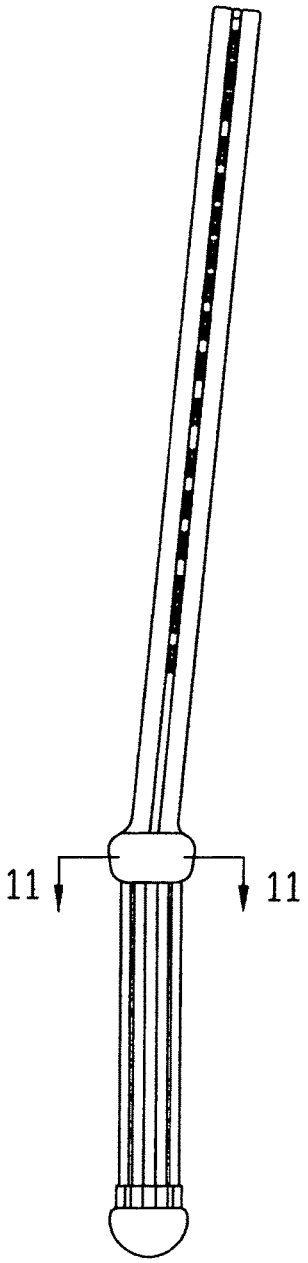
FIG. 3 is another side view of the tennis racket FIG. 1, shown in the tilted position.

The typical spherical joint assembly is explained in FIG. 2B. The bottom segment 6 has an extruded outer clip 9, and has an inner spherical surface 21, an outer spherical surface 22, the flange 23, and the groove 29. The pulley 8 is assembled with the clip 9 for the free rotation in the groove 29, and has the groove 30 for the strings. The top segment 7 has an extruded an inner clip 14, and has an inner slot 25, an outer spherical surface 24, and the flange 26. The inner clip 14 is locking in the outer clip 9 within a locking space 27, which results in a spring effect in the joint. In the top segment 7, the inner clip 14 is the inner clip 14 is pressed to the bottom outer clip 9, and with balls 15 results in the flexible frame assembly.

The typical assembly of flexible ball 15 with the bottom segment 6, and top segment 7 is explained in FIG. 2A. The flexible ball 15 is placed in the bottom nest 12, and the upper nest 13 is held in by the tension from the spring effect in the spherical joint, as explained above.

The tennis racket handle 2 of FIGS. 1-3 and FIG. 10 has an extruded housing 49 to accommodate the strings tension mechanism 3.

Figure 9:
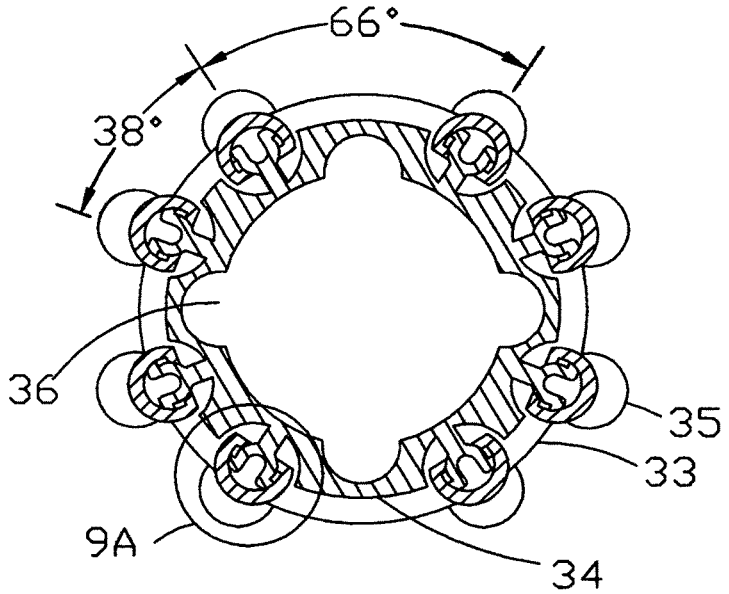
FIG. 9 is a sectional view the handle of FIG. 7 taken across section line 9-9 of FIG. 7.
Figure 9A:
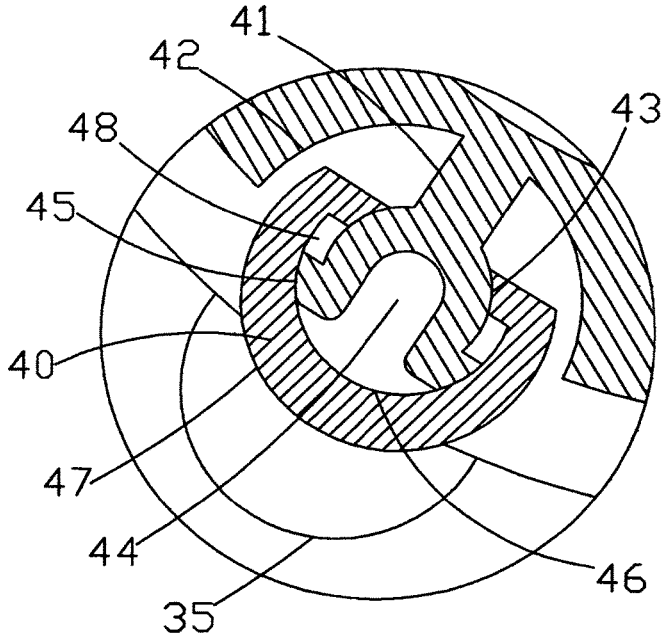
FIG. 9A is a sectional view of FIG. 9.

As shown on in FIGS. 6-11 and FIG. 9A, an outer extrusion of the housing 49 forms the protruded cylindrical segment 35, with an arrayal located on the cylindrical 33 at 66 and 38 degrees. As shown in FIG. 9A the protrusion has an inner slot 44 and the outer cylindrical surface 43 forms the flexible joint with the strip 40. The strip 40 forms the segment with an inner 46 and an outer 47 cylindrical surface.

Figure 6:
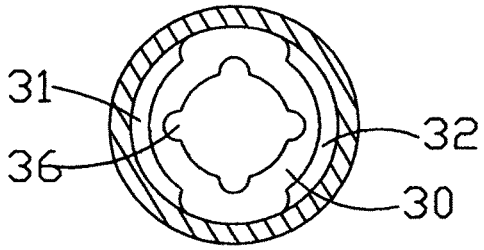
FIG. 6 is a sectional view of the tennis racket handle taken across section line 6-6 of FIG. 7.
Figure 7:
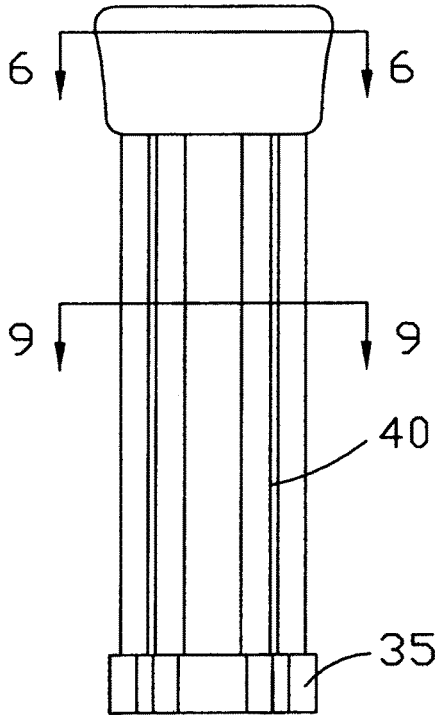
FIG. 7 is a front view of the tennis racket handle.
Figure 8:
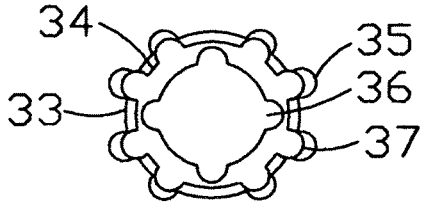
FIG. 8 is a bottom view of the handle of FIG. 7.

As shown on FIG. 6, an inner extrusion of the housing 49 forms the nest 30 for the head and the cylindrical groove 36 as the guide for the tension mechanism 3.

Figure 11:
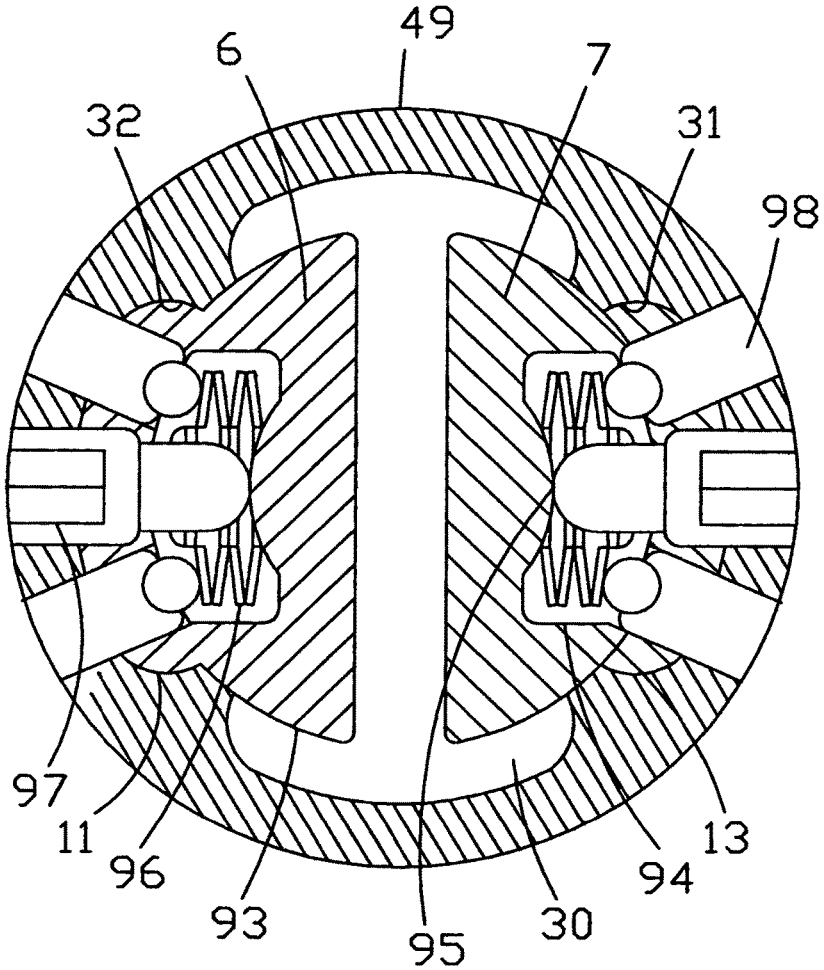
FIG. 11 is a sectional view of the spherical nest of the tennis racket of FIG. 1.

As shown on FIG. 1 and FIG. 11, the housing 49 has the nest to form the spherical joint with the head 1 and the handle 2 of the tennis racket. The head 1 with an outside spherical surface 93 is turning at 90 degrees in the nest 30 so the extrusion 11, 13 accommodates the grooves 31 and 32. The locking position is performed by the tension from the spring disc 96 to the spherical extrusion 95 on the bottom segment 6, and the top segment 7 of the tennis racket head 1. The discs are located in the cavity 94, and centrally rested on the screw shoulder 97, and loaded by the set screw 98.

Figure 10:
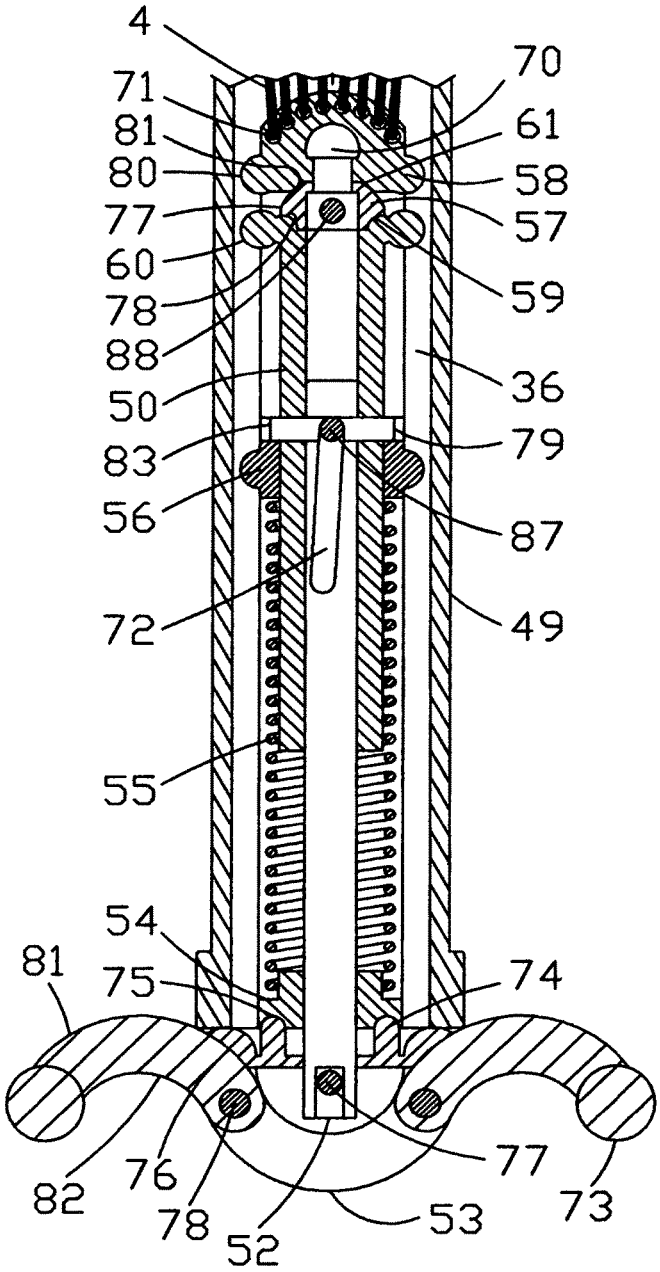
FIG. 10 is a sectional view of the handle of FIG. 7 taken across section line 10-10 of FIG. 2.

In FIG. 1 and FIG. 10, the string tension mechanism 3 is accommodated in the housing 49 of the tennis racket handle 2. The strings tension mechanism 3 includes the main shaft 50, the inner shaft 52, the lower clamp 53, the middle clamp 57, the upper clamp 58, the nut 56, and the compression spring 55, and the assembly pins 85, 86, 87, 88.

The main shaft 50 is in a cylindrical shape and has the spherical extrusion 80 for the guide in the groove 36, has the cylindrical inner hole to fit the inner shaft 52, and has the inner spherical surface 59 to fit with the middle clamp 57. The main shaft 50 has the acme thread and the helical slot 72 for the coarse movement.

The inner shaft 52 has the outside spherical shape 70 to fit with the upper clamp 58, and has the hole for the pin 87 to assemble with the middle clamp 57. On the other side, the inner shaft 52 has the hole for the pin 77 to assemble with the lower clamp 53, and the socket for the dial torque wrenches.

The lower clamp 53, FIG. 10 has arrayal located spherical protrusions 74, to fit the spring holder 54 into the cavity 75 and the retractable handle 73. The handle 73, with the outer spherical surface 82 and further mounted into the groove 76 by the pin 86 for the rotation with the inner shaft 52. The lower clamp 53 has centrally located the hole to assembly with the inner shaft 52 by the pin 88.

As shown in FIG. 10, the middle clamp 57 has an outer spherical surface 77, 78 to fit the main shaft and the upper clamp 58 and has centrally located the cavity 79 to assemble with the inner shaft by the pin 88.

As shown in FIG. 10, the upper clamp 58 has the pattern of the hole 71 to fit the strings 4, the protruded sphere 80 to guide in the groove 36, to assembly with the inner shaft 52.

With respect to FIG. 1 and FIG. 10, as the handle 73 rotates the inner shaft 52, the pin 87 slides in the helical slot 72, the nut groove 83, and activates the main shaft 50 to rotate in the nut 56. Further rotation of the inner shaft 52 causes an engagement the spherical protrusion 74 into the cavity 75 of the spring holder 54, and creates the load on the compression spring 55 to the nut 56, and to the spring holder 54. The main shaft 50 rotates in the nest of the middle clamp 57, which results in the upper clamp 58 sliding in the groove 36 of the handle housing 49.

As shown in FIG. 1, FIG. 2B and FIG. 10, the strings 4 are arranged in the vertical, the horizontal, the cross pattern, and are mounted in the strings holes 71 of the upper clamp 58. The strings 4 slide in the groove 30 of the pulley 8 in the guide 10 and they are under the tension as the result of the rotation of an inner shaft 52. Applying the dial torque wrench indicates the desired level of the strings' 4 tension. Such an arrangement of the strings elements minimizes the friction and maximizes the life of the strings.

It should be understood that for foregoing description in only illustrative of the invention. Various alternatives and modifications can be devised by those skilled in the art without departing from the invention. Accordingly, the present invention is intended to encompass all such alternatives, modifications and variances that fall within the scope of appended claims.

What is claimed is:

1. A tennis racket, comprising:

a handle with flexible gripping;

a head connected in a spherical joint with the handle, the head defining an open interior and having tension elements that are strings crossing each other across the open interior to form a string pattern; and a string tension mechanism operatively connected to tension the strings and thereby the string pattern, the string tension mechanism being within the handle, the strings extending from within the handle to the head to cross each other across the open interior.

2. The tennis racket of claim 1, wherein the head is split into a top segment and a bottom segment, the top segment being pressed to the bottom segment by spherical clips and resting on flexible balls.

3. The tennis racket of claim 2, wherein the head has the spherical clips, a pulley and the strings.

4. The tennis racket of claim 3, wherein the spherical clips have a spring reaction, withhold by the flexible balls, the pulley and the strings.

5. The tennis racket of claim 4, wherein the strings slides in the pulley.

6. The tennis racket of claim 1, wherein the head is connected to the handle in a spherical nest.

7. The tennis racket of claim 6, wherein the head and the handle forms the flexible spherical joint with disc spring reaction.

8. The tennis racket of claim 7, wherein the spherical joint facilitates an angle of the head.

9. The tennis racket of claim 1, wherein the handle has a housing to accommodate the strings tension mechanism.

10. The tennis racket of claim 9, wherein the string tension mechanism is operatively connected to a main shaft, an inner shaft, a compression spring, a nut, and a helical slot.

11. The tennis racket of claim 10, wherein the main shaft has the helical slot and a thread.

12. The tennis racket of claim 11, wherein rotating the inner shaft as a pin slides in the helical slot causes the nut engagement with the main shaft.

13. The tennis racket of claim 12, wherein the inner shaft is connected to a lower clamp, a middle clamp and an upper clamp.

14. The tennis racket of claim 13 wherein the upper clamp is configured to engage with the strings, and to be slid in the housing.

15. The tennis racket of claim 14, wherein the lower clamp is mounted with the handle and is configured to engage with a spring holder.

16. The tennis racket of claim 15, wherein the spring holder engages with compression spring.

17. The tennis racket of claim 16, wherein the compression spring is engaged with the nut.

18. The tennis racket of claim 17, wherein rotation of the handle causes the tension of the strings.

19. The tennis racket of claim 18, wherein the handle has a flexible connection formed by strips and cylindrical clips.

20. The tennis racket of claim 19, wherein the handle housing has cylindrical protrusions on an outer surface.

21. The tennis racket of claim 1, wherein a head frame has an opening to form a passage for guiding the strings.

22. An interactive tennis racket, comprising a flexible head assembly, the flexible head assembly being split and assembled together by spherical joints and flexible balls, the flexible head assembly defining an open interior space;

a flexible handle;

strings that are tensioned and extend from the flexible handle to the flexible head assembly to cross each other across the open interior space of the head to form a strings pattern;

a spherical nest that assembles the flexible head assembly and the flexible handle in connection with each other;

means for setting personalized parameters pertaining to head angle, hardness of the flexible balls, and strings tension;

means for selecting the head angle with respect to the handle;

a strings tension mechanism within the handle, the strings being in contact with a pulley within the handle, the handle being retractable to apply a torque with the strings tension mechanism during a strings tensioning process; and a dial torque wrench configured to provide monitoring of a level of the strings tension.

* * * * *